US006790392B1

(12) United States Patent
Beeck et al.

(10) Patent No.: US 6,790,392 B1
(45) Date of Patent: Sep. 14, 2004

(54) APPLICATION OF A VAPOROUS MIST FOR SPINING SYSTEMS WITH RECTANGULAR NOZZLES

(75) Inventors: Heinz-Dieter Beeck, Frankfurt am Main (DE); Rainer Tietze, Nauheim (DE)

(73) Assignee: Zimmer Aktiengesellschaft, Frankfurt am Main (DE)

( * ) Notice: Subject to any disclaimer, the term of this patent is extended or adjusted under 35 U.S.C. 154(b) by 0 days.

(21) Appl. No.: 09/980,571

(22) PCT Filed: Apr. 14, 2000

(86) PCT No.: PCT/EP00/03390

§ 371 (c)(1),
(2), (4) Date: Jan. 3, 2002

(87) PCT Pub. No.: WO00/68475

PCT Pub. Date: Nov. 16, 2000

(30) Foreign Application Priority Data

May 5, 1999 (DE) ..... 199 20 682

(51) Int. Cl.[7] ..... D01D 4/04; D01D 5/08

(52) U.S. Cl. ..... 264/39; 264/169; 264/211.17; 425/72.2; 425/192 S; 425/225; 425/463; 425/464

(58) Field of Search ..... 264/39, 169, 211.14; 425/72.2, 192 S, 225, 463, 464

(56) References Cited

U.S. PATENT DOCUMENTS 4,124,668 A * 11/1978 Frohn ..... 264/39

FOREIGN PATENT DOCUMENTS

| | | | |
|---|---|---|---|
| DE | 2630055 A1 | * | 1/1978 |
| DE | 292275 A5 | * | 7/1991 |
| DE | 292684 A5 | * | 8/1991 |
| EP | 0971056 A1 | * | 1/2000 |
| JP | 52027814 A | * | 3/1977 |
| JP | 56134206 A | * | 10/1981 |

* cited by examiner

*Primary Examiner*—Leo B. Tentoni
(74) *Attorney, Agent, or Firm*—Herbert Dubno

(57) ABSTRACT

A method and apparatus for the steam misting of rectangular nozzles and spinning systems equipped therewith for producing polyamide filaments whereby the steam feed is conducted through a tube loop which is passed through the heating chamber of the spinning beam so that the steam is brought to the spinning temperature. Directly below the spinning beam and thus on the lower edge of the rectangular nozzle stack which is connected thereto, between the spinning beam and the after-heater, steam outlet bars are longitudinally applied. These steam outlet bars are equipped with a simple labyrinth for pressure equalization. The steam inlet is effected initially in each case centrally of the rectangular nozzle stack and transitions into an upwardly open and relatively broad distribution chamber along the rectangular nozzle stack. This vertical distribution chamber transitions into a horizontal and very small gap which is open into the spinning chamber at its mouth. The steam then travels in the direction of the nozzles transversely to the filament curtain. The ends of the rectangular nozzle stack need not be misted with steam.

8 Claims, 3 Drawing Sheets

APPLICATION OF A VAPOROUS MIST FOR SPINING SYSTEMS WITH RECTANGULAR NOZZLES

CROSS REFERENCE TO RELATED APPLICATIONS

This application is a national stage of PCT application PCT/EP00/03390 filed 14 Apr. 2000 and based upon German national application 19920682.1 itself filed 5 May 1999 under the International Convention.

FIELD OF THE INVENTION

The present invention relates to the use of steam misting in the production of polyamide filaments, especially for rectangular spinning nozzles in accordance with the bottom loading concept and a spinning system equipped therewith.

In the spinning of polyamides, especially for polyamide 6 (nylon 6), during the discharge of the filaments from the spinning nozzles monomers and oligomers in the form of unpleasant smoke clouds are produced which can be released in an uncontrolled manner into the surroundings. In order to prevent this, these emissions can be evacuated via suction nozzles which must be provided as close as possible to the spinneret outlets. The functions and the shapes of such suction nozzles have been made known in DE 198 36 682.5. From DE 198 30 453.6 it is known, further, that superheated steam which serves to moisten the polyamide filaments and to support the suction effect, can simultaneously increase the wiping interval time for the spinning nozzle when blown directly thereagainst.

Conventional devices which serve for the aforedescribed purposes are damaged however during the cleaning or replacement of the nozzles. Thus it has been, for example, proposed at one time to provide the conventional nozzle misting so that the steam is blown onto the longitudinal side of a rectangular nozzle stack centrally against the side wall of the relevant nozzle stack so that it then flows in the gap between the nozzle stack and the nozzle shaft in the spinning beam downwardly and is rerouted by a baffle plate more or less uniformly in the direction of the spinning plate. This device is, apart from the insufficiency of the moisturization produced, not usable for rectangular nozzle stacks in accordance with the bottom loading concept, is effective even to a lesser extent than is the solution for round spinning nozzles from the application DE 198 30 453.6 which differs based upon the after-heater which is directly following and also is not practical.

OBJECT OF THE INVENTION

Thus it is the object to provide a reliable apparatus, which is service-friendly and is easy to clean, for the steam moisturization of rectangular nozzles.

SUMMARY OF THE INVENTION

The advantage of the new steam misting resides in the good temperature control of the steam, whereby the steam feed is effected through a tube loop which passes through the heating chamber of the spinning beam so as to bring the steam up to the spinning temperature. Advantageously, the steam outlet bars are directly below the spinning beam and thus on the lower edges of the rectangular nozzle stack connected therewith, between the spinning beam and the after-heater. These steam outlet bars are equipped with a simple labyrinth for pressure equalization which can be fabricated especially inexpensively. The steam inlet is effected initially respectively centrally to the rectangular nozzle stack and into an upwardly open and relatively broad distribution chamber along the rectangular nozzle stack.

This vertical distribution chamber transitions into a horizontal and very narrow gap space which opens into the spinning chamber. As the steam enters into the latter, the steam is spread out and uniformly flows in the direction of the nozzles. This is so effective that a misting from the ends inwardly is superfluous.

BRIEF DESCRIPTION OF THE DRAWING

A more detailed description of the method and the apparatus for steam misting of rectangular nozzles and the spinning system equipped therewith for producing polyamide filaments is provided below in conjunction with the drawings.

Thus in the drawings

SPECIFIC DESCRIPTION

Figure 1:
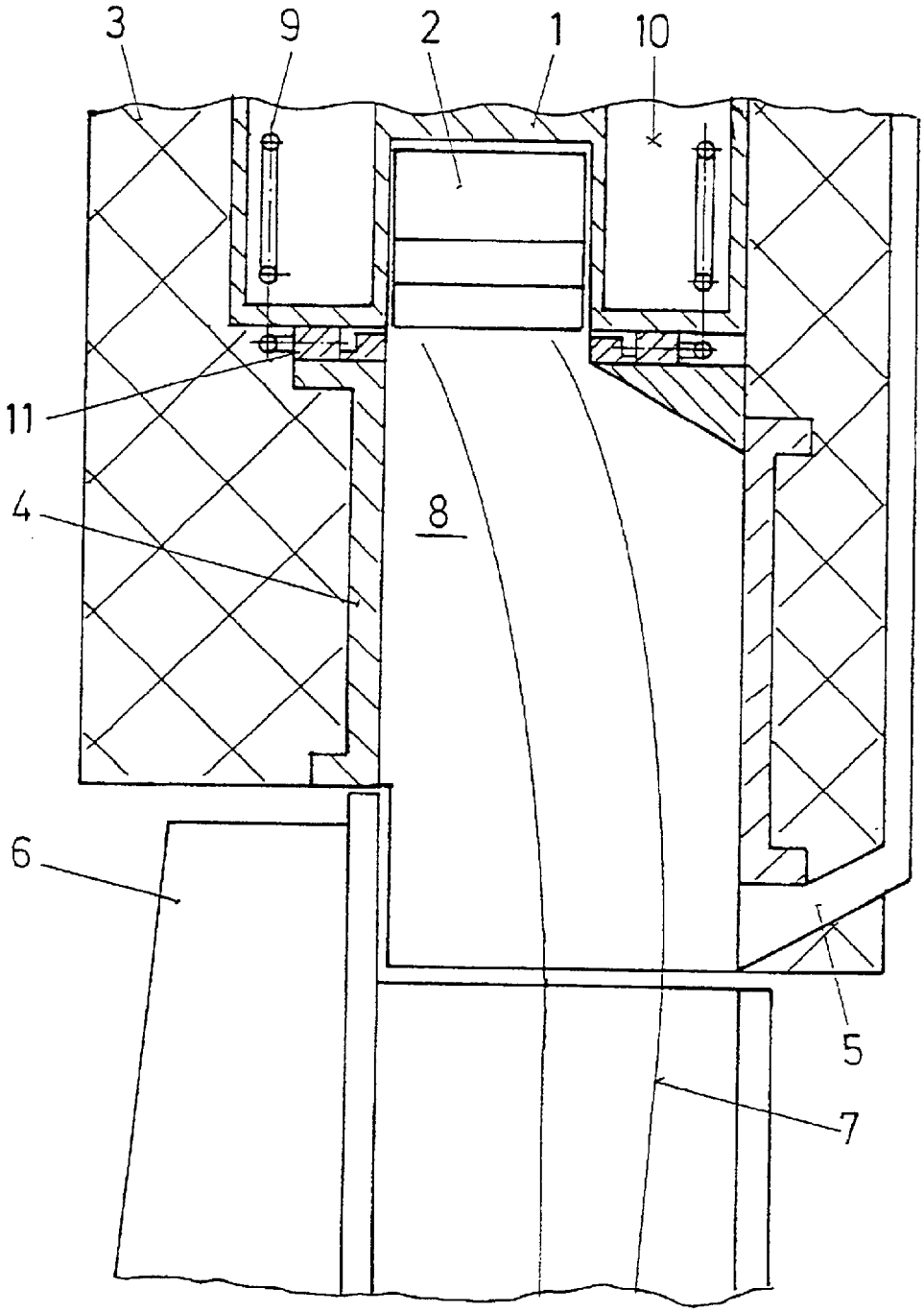
FIG. 1 shows a section through a spinning beam into which the unit for steam misting of the invention is built.

FIG. 1 shows an exemplary spinning system. The section is through a spinning beam 1 with rectangular nozzles 2, its insulation 3 and the after-heater 4 as well as the monomer suction 5. Below the spinning beam one can see the blowing device 6 and here also is represented the filament curtain 7 in the spinning chamber 8 of the after-heater 4. The steam feed is effected via a pipe loop 9 which extends through the heating chamber 10 of the spinning beam 1 so that already superheated steam is brought further to the spinning temperature. Directly below the spinning beam 1 and thus on the lower edge of the rectangular nozzle stack 2 which is connected thereto, between the spinning beam 1 and the after-heater 4, on a longitudinal side—and with very wide spinning stacks on both sides—steam outlet bars 11 are provided which are each comprised of a base bar 12 and a distributor bar 13 forming together with the lower edge of the spinning beam 1 a labyrinth distribution chamber 14 which is described in greater detail below. The ends of the rectangular nozzle stack 2 do not need to be sprayed with steam however in any case.

Figure 2:
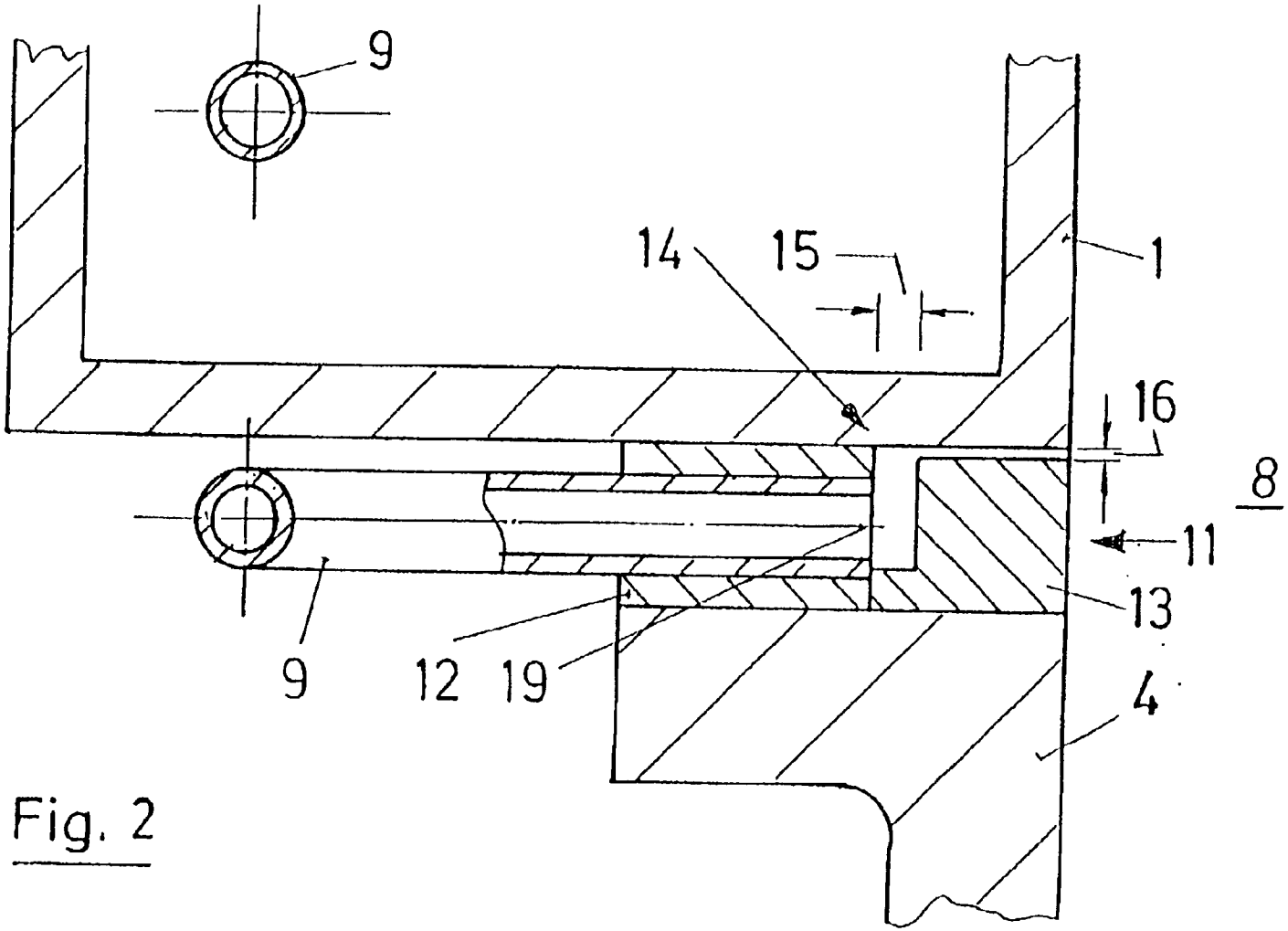
FIG. 2 shows a detail section of the steam misting unit in its assembled state.

In FIG. 2, the steam outlet bar 11 for the steam misting has been shown in a detail section in its assembled state, i.e. ready for operation and fixed between the spinning beam 1 and the after-heater 4. These steam outlet bars 11 are equipped with a simple labyrinth distribution chamber 14, for pressure equalization. This labyrinth-like distribution chamber 14 is laterally bounded by the base bar 12 and from above by the lower edge of the spinning beam 1 and itself can be formed mainly from cutouts 15, 16 in the distributor bar, forming a vertical distribution chamber 15 and a horizontal gap 16. From the pipe loop 9 the steam is introduced at 19 initially respectively centrally through the base bar 12, i.e. also centrally with respect to the rectangular nozzle stack 2 and opens into the upwardly open and relatively broad distribution chamber 15 longitudinally into the distribution bar 13. This vertical passage 15 transitions on into a horizontal, very small gap 16 which opens into the spinning chamber 8. From this passage 16 the steam then flows in the direction of the nozzles transversely to the filament curtain 7.

Figure 3:
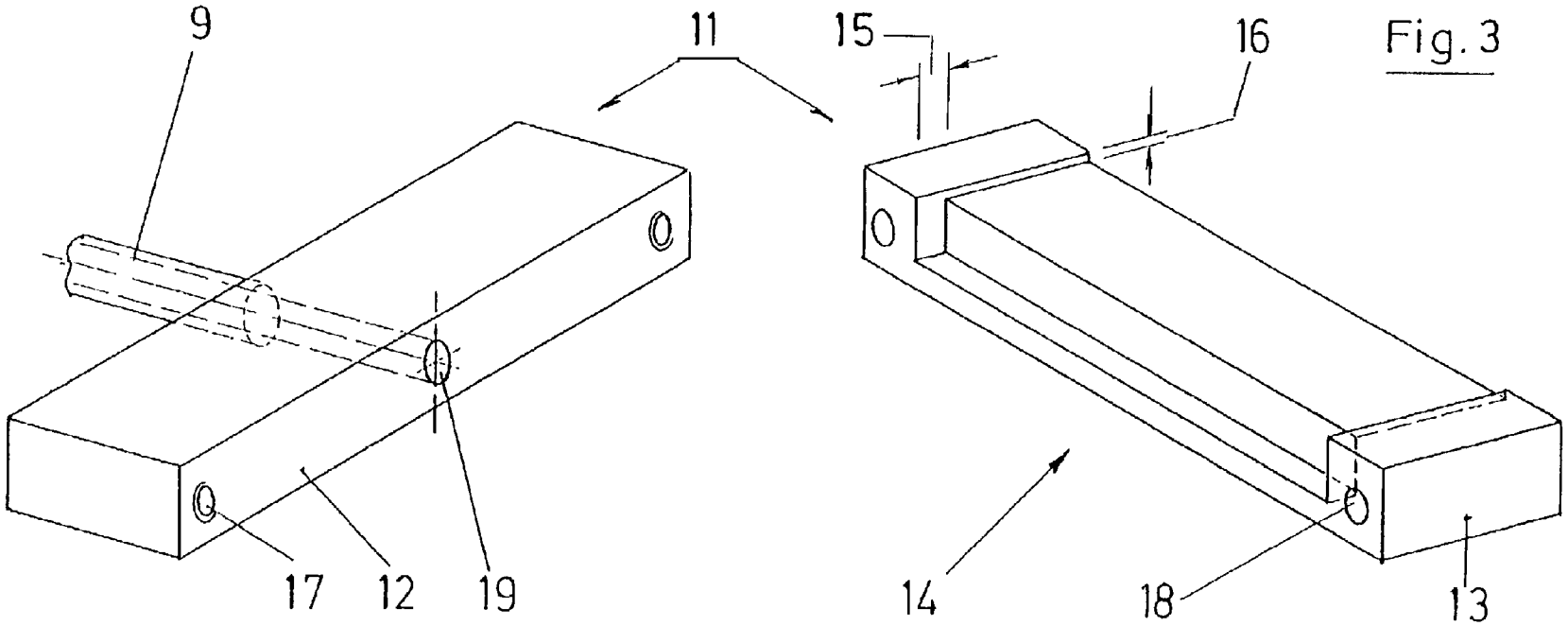
FIG. 3 shows a detail section of the steam misting unit in the disassembled state.

FIG. 3 shows a steam outlet bar 11 in its disassembled state. On the base part 12 one can see the steam inlet 19 and the end of the tube loop 9 opening into it as well as the two fastening screw threads 17 for the distributor bar 13. On the distributor bar 13 one can recognize the screw hole 18 and the openly accessible cutouts 15, 16 for cleaning, namely, the vertical distribution chamber 15 and the narrower horizontal gap 16 which form the steam distribution labyrinth 14 once the device is completely assembled as has already been described.

The steam misting system is primarily conceived for use in apparatus for the spinning of high-strength polyamide yarns, but it can however be used universally wherever a spinning outlet surface is to be misted with steam or a moist spinning atmosphere is to be obtained. The use is therefore not limited only to bottom-loading spinning systems.

The pressure equalizing and labyrinth-light distribution chambers can respectively be provided on both longitudinal sides of the rectangular nozzle stack. The first passage 15, i.e. the larger passage, can have two to a maximum of five times greater rectangular cross section in the subsequent second passage 16.

We claim:

1. A method steam misting of rectangular nozzles and spinning systems equipped therewith for producing polyamide filaments, comprising the steps of:

feeding steam required for the steam misting initially through a tube loop lying in a heating portion of a spinning beam in order to heat the steam approximately to the same temperature as a spinning temperature;

then passing the steam through a pressure equalizing distribution chamber and then directly emitting the steam along an entire longitudinal side of a rectangular nozzle stack; and finally directed the steam in a uniformly distributed manner in a spinning chamber below said spinning beam to a spinning plate thereof.

2. The method defined in claim 1 wherein the pressure equalizing distribution chamber is arranged respectively along a single longitudinal side of said rectangular nozzle stack and is configured in a labyrinth shape and is fed only by a single steam inlet from the tube loop centrally.

3. The method defined in claim 2 wherein said pressure equalizing distribution chambers are respectively provided on both longitudinal sides of the rectangular nozzle stack.

4. The method defined in claim 2 wherein the pressure equalizing distribution chamber which has a single centrally oriented steam inlet is comprised of at least two passages with rectangular cross sections, which are open on their longitudinal sides and transition between one another at right angles, whereby a first of said passages has two to a maximum of five times greater rectangular cross section than a second of said passages.

5. The method defined in claim 2 wherein the pressure equalizing distribution chamber which has a single central and horizontally oriented steam inlet has at least two passages with rectangular cross sections which are open at their longitudinal sides and transition between them at right angles, whereby a first of said passages is larger and has an upwardly open rectangular cross section which runs into a right angled horizontal and very small gap of a second of said passages which then opens with one longitudinal sides into the spinning chamber and through which the steam is uniformly distributed transversely to a filament curtain in the direction of the nozzle stack.

6. An apparatus for the steam misting of a rectangular nozzle and a spinning systems equipped therewith comprising a pressure equalized and labyrinth-like distribution having a single steam inlet, a steam outlet bar comprised of at least two bars attached together by screws whereby a respective base part with the central steam inlet is fixed between a spinning beam and an after-heater, and a distributor part so connected by screws to the base part that it can be removed for cleaning.

7. The apparatus according to wherein the pressure equalizing and labyrinth-shaped distribution chamber which follows the single steam inlet is configured as a simple steam equalizing labyrinth which is formed first by the fixed and smooth walls of the base bar, second by a fixed and smooth underside of the spinning beam (1), and third and fourth by the cutouts in the distributor bar.

8. An apparatus for steam misting a spun curtain of filaments which comprises:

a spinning beam having rectangular nozzles from which a curtain of filaments issues into a spinning chamber below said nozzles, said nozzles being flanked by a pair of heating chambers;

a piping loop in one of said chambers for supplying superheated stem brought to a spinning temperature by passage of the steam through said loop;

an elongated steam distributor extending longitudinally along a longitudinal side of said spinning chamber below said nozzles and opening into said spinning chamber through a narrow slot; and a steam outlet bar defining with said elongated steam distributor a distribution chamber wider than said slot and communicating with said slot along the length thereof, said steam outlet bar having a single opening centrally of said outlet bar and said steam distributor and receiving steam from said loop and discharging steam into said distribution.

* * * * *